US008415868B2

(12) United States Patent
Gerhard et al.

(10) Patent No.: US 8,415,868 B2
(45) Date of Patent: Apr. 9, 2013

(54) HIGH-PRESSURE DISCHARGE LAMP AND A METHOD OF MANUFACTURING A HIGH-PRESSURE DISCHARGE LAMP

(75) Inventors: Markus Gerhard, Aachen (DE); Herbert Schartmann, Stolberg/Rheinland (DE); Manfred Westemeyer, Aldenhoven (DE); Ralf Muckel, Aachen (DE); Wilfried Emunds, Alsdorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/988,538

(22) PCT Filed: Apr. 20, 2009

(86) PCT No.: PCT/IB2009/051615

§ 371 (c)(1), (2), (4) Date: Oct. 19, 2010

(87) PCT Pub. No.: WO2009/130654

PCT Pub. Date: Oct. 29, 2009

(65) Prior Publication Data

US 2011/0037374 A1 Feb. 17, 2011

(30) Foreign Application Priority Data

Apr. 25, 2008 (EP) ..... 08103726

(51) Int. Cl.

| | |
|---|---|
| ***H01J 5/48*** | (2006.01) |
| ***H01J 5/54*** | (2006.01) |
| ***H01J 9/24*** | (2006.01) |

(52) U.S. Cl. ..... 313/318.01; 313/634; 313/635; 313/49; 455/26; 455/23

(58) Field of Classification Search . 313/318.01–318.08
See application file for complete search history.

(56) References Cited

U.S. PATENT DOCUMENTS

| | | | | |
|---|---|---|---|---|
| 4,609,977 | A | | 9/1986 | Eckhardt et al. |
| 5,216,318 | A | * | 6/1993 | Van Dulmen et al. ..... 313/49 |
| 5,339,002 | A | * | 8/1994 | Braun et al. ..... 313/318.1 |
| 5,428,261 | A | | 6/1995 | Wittig et al. |
| 5,453,656 | A | * | 9/1995 | Ui ..... 313/318.12 |
| 5,742,114 | A | * | 4/1998 | Kohl et al. ..... 313/318.01 |
| 5,957,569 | A | | 9/1999 | Helbig et al. |
| 5,971,573 | A | * | 10/1999 | Bucher et al. ..... 362/438 |

(Continued)

*Primary Examiner* — Sikha Roy

(57) ABSTRACT

A lamp (10) for an automotive headlamp and a method for manufacturing such kind of a lamp (10) is provided, wherein the lamp (10) comprises a burner (12) for emitting light, a metal holder (20) connected to the burner (12) for supporting the burner (12), a first socket part (32) made from a heat-resistant plastic material, which is connected to the burner (12), and a second socket part (34), through which a part of the burner (12), which is connected to a first electrical pole (14), is led for connecting the burner (12) to a voltage source, wherein the second socket part (34) is arranged adjacent to the first socket part (32) such, that at least one insulating gap (42) for providing voltage resistance in mainly radial and/or axial direction is provided. Due to the first socket part (32) it is possible to receive the hot burner (12) by the socket without impairing the heat resistance, wherein the second socket part (34) may be made from a cheaper material. This leads to a reduction of production costs without impairing the heat resistance or the voltage resistance provided by the insulating gap (42) between the first socket part (32) and the second socket part (34).

15 Claims, 2 Drawing Sheets

U.S. PATENT DOCUMENTS 6,031,323 A 2/2000 Behr et al.
6,215,236 B1 * 4/2001 Gotoh et al. ..... 313/318.07
6,350,964 B1 * 2/2002 Boas et al. ..... 219/390
6,462,476 B1 10/2002 Hirschmann et al.
6,628,081 B2 * 9/2003 Behr et al. ..... 315/56
7,002,285 B2 * 2/2006 Mudra et al. ..... 313/318.01
7,083,476 B2 8/2006 Helbig et al.
7,119,483 B2 10/2006 Westemeyer et al.
2007/0019423 A1 1/2007 Westemeyer et al.

* cited by examiner

HIGH-PRESSURE DISCHARGE LAMP AND A METHOD OF MANUFACTURING A HIGH-PRESSURE DISCHARGE LAMP

FIELD OF THE INVENTION

The invention relates to the field of lamps, particularly high-pressure discharge lamps, and more specifically to a motor vehicle headlight. The invention relates further to a method of manufacturing such a kind of lamp.

BACKGROUND OF THE INVENTION

In U.S. Pat. No. 7,119,483 B2 a high-pressure discharge lamp is disclosed, which can be used as motor vehicle headlight. The high-pressure discharge lamp comprises a burner for emitting light held by three or four metal alignment legs, which are inserted into a socket made of plastic material. Since the burner of a high-pressure discharge lamp becomes very hot during use, for instance more than 105° C., the plastic material of the socket is selected with respect to a good heat resistance, for instance PPS (polyphenylene sulfide, $(SC_6H_4)_n$).

There is a permanent need to reduce production costs of the manufacture of lamps without impairing the heat resistance or the voltage resistance.

SUMMARY OF THE INVENTION

It is an object of the invention to provide a lamp, particularly a high-pressure discharge lamp, as well as a method of manufacturing such kind of a lamp, which enables a reduction of production costs without impairing the heat resistance or the voltage resistance of the lamp.

This object is achieved by a lamp for an automotive headlamp, comprising a burner for emitting light, a metal holder connected to the burner for supporting the burner, a first socket part made from a heat-resistant plastic material, which is connected to the burner, and a second socket part, through which a part of the burner, which is connected to a first electrical pole, is led for connecting the burner to a voltage source, wherein the second socket part is arranged adjacent to the first socket part such, that at least one insulating gap for providing voltage resistance in mainly radial and/or axial direction is provided.

Due to the first socket part it is possible to receive the hot burner by the socket without impairing the heat resistance. Particularly the first socket part comprises an extension in axial direction of the lamp, which is barely long enough to contact the burner along a length comprising such a high temperature necessary for providing the heat-resistant material. The remaining part of the socket, this means the second socket part, may be provided by a material of a lower heat resistance, which may be cheaper and more cost efficient. Due to the reduced material costs the production costs of the manufacture of the lamp is reduced. In addition the insulating gap between the first socket part and the second socket part provides sufficient insulation, so that the voltage resistance of the lamp is not impaired. Particularly the insulating gap is designed to provide an increased voltage resistance, so that the metal holder may at least partially cover the socket without increasing the risk of an unwanted voltage lightning between the burner and the holder. The insulating gab comprises particularly a width d of 0.05 mm$\leqq$d$\leqq$1.0 mm, preferably 0.1 mm$\leqq$d$\leqq$0.5 mm and most preferred 0.15 mm$\leqq$d$\leqq$0.25 mm. Due to the covering holder components of the used plastic material of the socket, which may outgas at high temperatures, are kept inside lamp, particularly within the covering metal holder, so that these components do not condensate at a reflector of a motor vehicle headlamp or the like but at the holder or the socket parts. The reduction of the optical performance of the lamp over the life time is reduced or even eliminated and the life time increased. Further the surface of the holder may be increased without increasing the risk of an unwanted voltage lightning between the burner and the holder. Due to the increased surface of the holder, particularly covering the socket parts, the passive cooling of the burner via the holder is increased leading to a reduced temperature of the burner at least at the outside surface. This in turn makes it possible to reduce the amount of the provided heat-resistant material and to reduce the size of the first socket part.

Particularly the holder comprises alignment legs for aligning the burner with respect to the holder before connecting the burner to the alignment legs, wherein the alignment legs protrude partially in proximal direction. Since the alignment legs protrude not towards the tip of the burner but towards the socket, the burner may be arranged partially inside the socket or a cap of the holder. This leads to a reduced assembling space without the need of providing a shortened burner. A significant space between the burner and the socket leading to an increased length is prevented, wherein at the same time enough space is still present for bending the alignment legs in several directions in order to provide a correct alignment of the burner with respect to the holder.

Preferably the holder comprises a cap protruding mainly in axial direction, particularly for receiving the first socket part and/or the second socket part. Due to the cap covering the socket parts components of the used plastic material of the socket, which may outgas at high temperatures, are kept inside lamp, particularly within the cap of the holder, so that these components may only condensate at the cap or the socket parts. Further an increased cooling surface of the cap is provided, so that an increased heat transport from the burner away is possible leading to an increased cooling of the burner. Further the cap provides an increased electromagnetic influence protection.

Particularly the holder is electrically connected to a second electrical pole of the burner. Due to the electrical connection of the holder and the second pole electrical energy may be lead by means of the holder. Additional wires, lines or connectors are not necessary. This leads to a reduced number of assembling parts and reduced manufacturing costs.

Preferably the second socket part, particularly only the second socket part, comprises at least two cavities spaced to each other in radial direction for providing the insulation gaps. Since the second socket part is not designed with respect to a high heat resistance, more different materials are applicable for the second socket part. Particularly a plastic material is chosen, that allows providing complicated forms and/or thin ribs and the like, preferably by injection molding. Thus it is possible to optimize the second socket part with respect of providing an increased dielectric.

Preferably the first socket part and/or the second socket part comprise several protrusions spaced to each other for providing a labyrinth-like insulating gap. The distance an unwanted discharge lightning between the burner and the holder would have to take may be maximized by the labyrinth-like insulating gap, wherein the protrusions are easily to be manufactured. A compact design, particularly at the socket, is possible without impairing the voltage resistance at high applied voltages of for instance 25 kV.

In a preferred embodiment the first socket part is connected to the burner and/or to the holder and/or to the second socket part by at least partially melting the first socket part, particularly by contactless high frequency melting. Due to the melting a gap-free connection may be provided, so that a good heat resistance and a good voltage resistance at the same time are safeguarded.

Particularly the first socket part is adapted for providing voltage resistance in mainly axial direction and the second socket part is adapted for providing voltage resistance in mainly radial direction. Since the functions of providing voltage resistance in axial and radial direction of the lamp are divided to two different parts, it is possible to optimize the first socket part and the second socket part independently from each other with respect to its respective voltage resistance function. This leads to an increased overall voltage resistance of the lamp.

Preferably the first socket part comprises PPS and/or the second socket part comprises PE or PA. This choice of plastic materials for the socket parts leads to a cost efficient socket, which is still able to deal with a hot burner.

Particularly the insulating gap is filled with air and/or comprises a negative pressure. Since the insulating gap is not filled with electric conductive materials a high dielectric is provided by the insulating gap. Particularly when the assembling of the socket is performed at a negative pressure, an increased dielectric of the insulating gap may be provided and volatile components, particularly of the plastic socket, may be removed at the same time.

Preferably the holder comprises a holding part particularly for supporting the burner and a cap for receiving the first socket part and/or the second socket part, wherein the holding part is particularly fixed to the cap. Due to the two-part design of the holder it is possible to provide only two assembling units, which can be assembled by one connecting step, wherein the burner is connected to the holding part prior to perform the correct alignment of the burner and to receive the first assembling unit. The second assembling unit may be received by putting the first socket part and the second socket part into the metal cap of the holder. Both assembling units may then be put together and connected to each other by partially melting the first socket part, so that the first socket part is bond to the cap, to the second socket part and the burner. If so, the holding part and the cap may be connected directly to each other particularly by laser welding. this leads to a faster and facilitated assembling process.

The invention further relates to a headlamp for a motor vehicle comprising a lamp, which may be designed as previously described. Due to the lamp the headlamp enables a reduction of production costs without impairing the heat resistance or the voltage resistance of the lamp.

The object of the invention is further achieved by a method for manufacturing a lamp, which may be designed as previously described, comprising the steps aligning the burner with respect to the holder, fixing the burner to the holder, positioning the first socket part with respect to the holder such, that the first socket part receives a part of the burner, fixing the first socket part to the received burner and positioning the second socket part with respect to the first socket part such, that the insulating gap for providing voltage resistance in mainly radial direction is provided. Due to this method it is possible to provide a lamp, which enables a reduction of production costs without impairing the heat resistance or the voltage resistance of the lamp, by a less number of manufacturing steps for instance as previously described with respect to the lamp.

Particularly the first socket part is fixed to the holder while fixing the first socket part to the burner. Preferably the first socket part is fixed to the second socket part while fixing the first socket part to the burner. Since several fixing operations are done at the same time, the assembling time may be reduced. Particularly these fixing operations are done within one single fixing step, for instance by partially melting the first socket part. Due to an easily to perform melting of the first socket part, for instance by high frequency melting, the fixing step can be performed fast, wherein several fixing operation can be performed at the same time.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
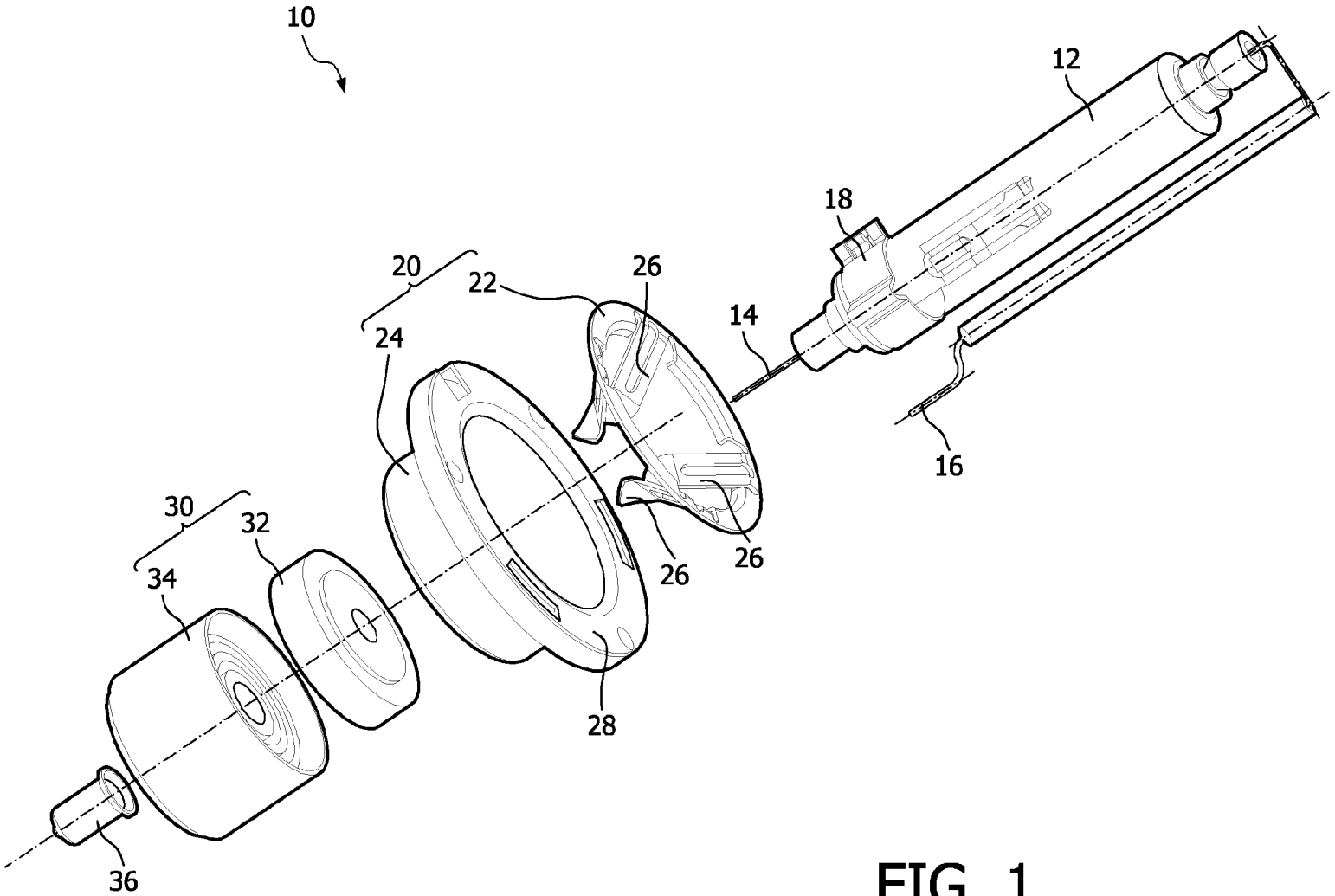
FIG. 1 is a schematic exploded view of a lamp according to the invention and FIG. 2 is a schematic sectional view of the lamp of FIG. 1.

The lamp 10 illustrated in FIG. 1 is designed in the illustrated embodiment as a high-pressure discharge lamp for use as headlight for an automobile. The lamp 10 comprises a burner 12, which comprises a first pole 14 and a second pole 16 for the application of an electrical voltage. The burner 12 is partially surrounded in circumferential direction by a metal collar 18, which is clamped to the burner 12.

The lamp 10 further comprises a holder 20, which comprises in the illustrated embodiment a holding part 22 for supporting the burner 12 and a cap 24. The holding part 22 comprises four alignment legs 26, which may be connected to the collar 18 by laser welding for fixing the burner 12 in a correct alignment with respect to the holding part 22. The cap 24 comprises a metal ring 28, to which the holding part 22 may be connected by laser welding in a correct alignment of the burner 12 with respect to the cap 24 or the ring 28. Since the alignment legs 26 protrudes in proximal direction, this means away from the tip of the burner 12 and towards a socket 30, the burner 12 is partially arranged inside the cap 24.

The cap 24 may be connected to a first socket part 32 and a second socket part 34, which consists of different materials. The first socket part 32 comprises mainly PPS and the second socket part 34 comprises mainly PE, PP or PA. Further a pin 36 is provided, which may be connected to the second socket part 34 and electrically connected to the first pole 14 of the burner 12. The second pole 16 of the burner 12 may be connected for instance by laser welding to the holding part 22 of the holder 20, so that an electrical source may by applied to the burner 12 via the pin 36 and the holder 20.

Figure 2:
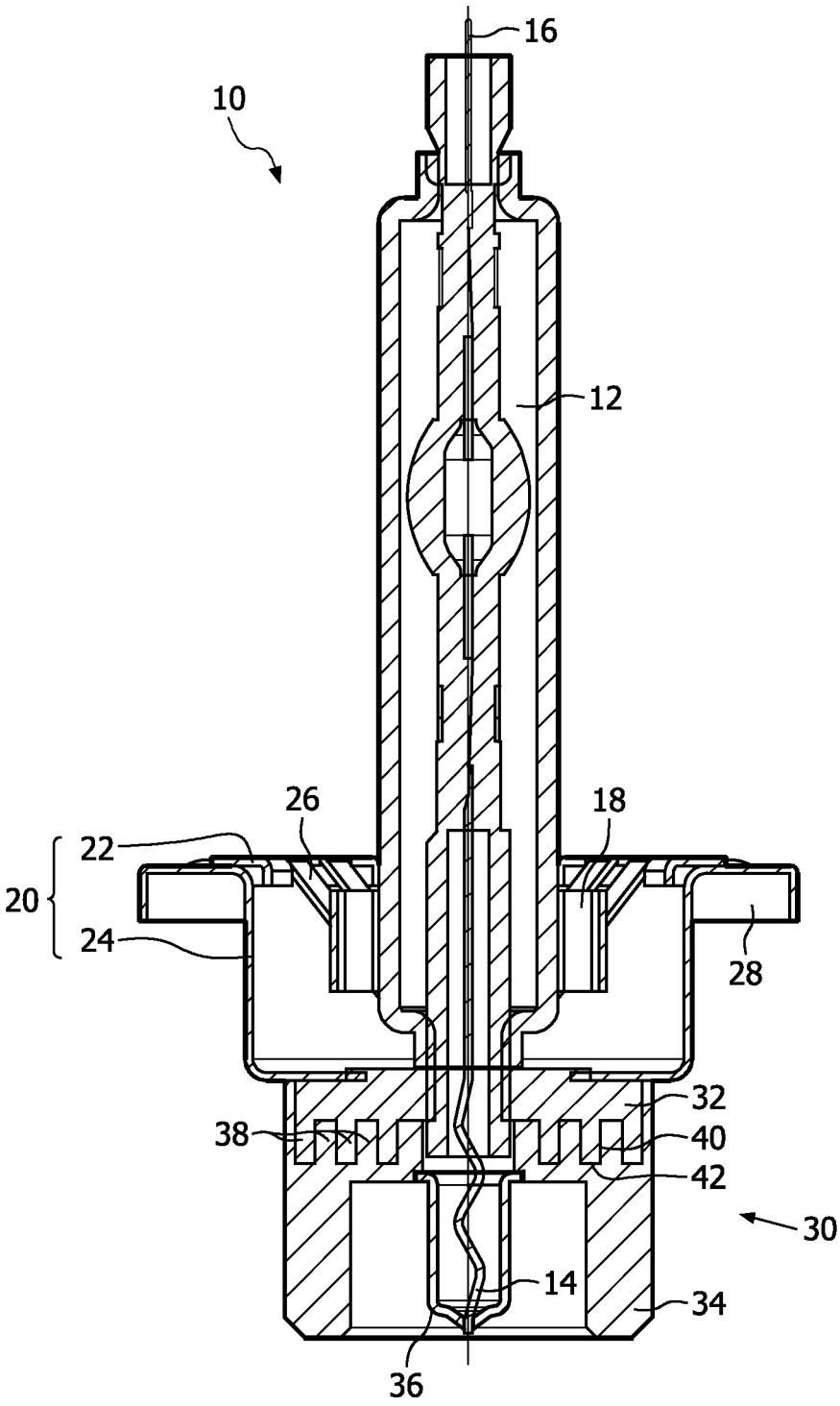

As illustrated in FIG. 2 the first socket part 32 and the second socket part 34 each comprises several protrusions 38 between them small cavities 40 are formed, which are connected to each other by slits between a respective protrusion 38 and the other socket part 32, 34, so that a labyrinth-like insulating gap 42 is formed between the first socket part 32 and the second socket part 34. Since a small gap width is sufficient to provide a voltage resistance in axial and radial direction of the lamp 10, the insulating gap 42 is illustrated in FIG. 2 by a bold line for purpose of clarity.

While the invention has been illustrated and described in detail in the drawings and foregoing description, such illustration and description are to be considered illustrative or exemplary and not restrictive; the invention is not limited to the disclosed embodiments. For example, it is possible to operate the invention in an embodiment wherein the cap 24 of the holder 20 protrudes in axial direction such, that the first socket part 32 and the second socket part 34 are received. Further it is possible not to connect the second pole 16 of the burner 12 to the holder 20 but to lead the second pole insulated with respect to the holder 20 to an electrical voltage source. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A high-pressure discharge lamp, comprising:

a burner for emitting light, the burner including proximal and distal ends;

first and second electrical poles respectively attached at the proximal and distal ends for application of electrical voltage;

a holder having a holding part for supporting the burner at the proximal end;

a pin for electrically connecting to the first pole of the burner; and first and second socket parts attached to the holder, each socket part including:

an axial opening for enabling the first electrical pole to connect to the pin; and a plurality of protrusions and a plurality of cavities between the protrusions for interconnecting the first and second socket parts, the plurality of cavities forming insulating gaps providing a voltage resistance in axial and radial directions of the burner.

2. The lamp according to claim 1, wherein the holder comprises a plurality of alignment legs for aligning the burner with respect to the holder, the alignment legs protrude partially in a proximal direction.

3. The lamp according to claim 1, wherein the holder comprises a cap protruding mainly in an axial direction for receiving the first socket part and/or the second socket part, the cap includes a metal ring for connecting to the holding part in a predetermined alignment of the burner with respect to the cap.

4. The lamp according to claim 1, wherein the holder is electrically connected to the second electrical pole.

5. The lamp according to claim 1, wherein the plurality of cavities are spaced from each other a radial direction for providing the insulation gaps.

6. The lamp according to claim 1, wherein the first socket part comprises mainly polyphenylene sulfide and the second socket part comprises mainly PE, PP or PA.

7. The lamp according to claim 1, wherein the first socket part is connected to at least one of the burner, the holder and the second socket part.

8. The lamp according to claim 1, wherein the first socket part is adapted for providing voltage resistance in mainly the axial direction and the second socket part is adapted for providing voltage resistance in mainly the radial direction.

9. The lamp according to claim 1, wherein the first socket part comprises PPS and/or the second socket part comprises PE or PA.

10. The lamp according to claim 1, wherein the insulating gap is filled with air and/or comprises a negative pressure.

11. The lamp according to claim 1, wherein the holder further comprises a cap for receiving the first socket part and/or the second socket part, the holding part is fixed to the cap.

12. The lamp according to claim 1, wherein the lamp is formed as an automotive headlight.

13. A method for manufacturing a high-pressure discharge lamp comprising a burner including first and second electrical poles, a holder having a holding part, a pin, first and second socket parts each including an axial opening and a plurality of protrusions, and a plurality of corresponding cavities between the protrusions forming insulating gaps for providing a voltage resistance in axial and radial directions of the burner, the method comprising acts of:

aligning the burner with respect to holder;

fixing the burner to the holder;

positioning the first socket part with respect to the older such, that he first socket part receives a part of the burner;

fixing the first socket part to the burner; and connecting the first electrical pole to the pin through the axial opening;

interconnecting the first and second socket parts such that the plurality of cavities between the interconnected protrusions of one the first and second socket parts accepting the protrusions of another of the first and second socket parts and the insulating gap provides voltage resistance in radial and axial directions of the burner.

14. The method according to claim 13, further comprising an act of fixing the first socket part to the holder while fixing the first socket part to the burner.

15. The method according to claim 13, further comprising an act of fixing the first socket part to the second socket part while fixing the first socket part to the burner.

* * * * *